US010287754B2

(12) United States Patent
Bjerke

(10) Patent No.: US 10,287,754 B2
(45) **Date of Patent: *May 14, 2019**

(54) MODULAR SIDEBAR PROTECTING WEAR MEMBER AND SYSTEM

(71) Applicant: Caterpillar Inc., Peoria, IL (US)

(72) Inventor: Nathan Bjerke, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/787,767

(22) Filed: Oct. 19, 2017

(65) Prior Publication Data

US 2018/0163379 A1 Jun. 14, 2018

Related U.S. Application Data

(60) Provisional application No. 62/433,878, filed on Dec. 14, 2016.

(51) Int. Cl.
*E02F 3/40* (2006.01)
*E02F 9/28* (2006.01)
*E02F 3/815* (2006.01)

(52) U.S. Cl.
CPC ..... *E02F 9/2883* (2013.01); *E02F 3/8157* (2013.01)

(58) Field of Classification Search
CPC ... E02F 3/40; E02F 9/2808; E02F 9/28; E02F 9/2883; E02F 9/2833; E02F 9/2816; E02F 9/2825; E02F 9/2858; E02F 9/2841; E02F 9/2891; E02F 3/8157
USPC ..... 37/444, 449, 451–453; 172/701.1–701.3
See application file for complete search history.

(56) References Cited

U.S. PATENT DOCUMENTS

| | | | | |
|---|---|---|---|---|
| 3,851,413 | A * | 12/1974 | Lukavich | E02F 9/2816 37/450 |
| 3,914,885 | A | 10/1975 | Moreau | |
| 6,751,897 | B2 * | 6/2004 | Bierwith | E02F 9/2816 37/446 |
| 6,834,449 | B2 * | 12/2004 | Leslie | E02F 3/60 37/398 |
| 9,903,092 | B2 * | 2/2018 | Lunn | E02F 3/40 |
| 2016/0160476 | A1 | 6/2016 | Serrurier et al. | |

FOREIGN PATENT DOCUMENTS

| | | |
|---|---|---|
| AU | 2012200114 | 1/2012 |
| DE | 202006017936 | 3/2007 |

* cited by examiner

*Primary Examiner* — Robert E Pezzuto
(74) *Attorney, Agent, or Firm* — Finnegan, Henderson, Farabow, Garrett & Dunner, LLP

(57) ABSTRACT

A sidebar protecting wear member includes a module having a length extending in a length direction from a first end to a second end, and a width extending in a width direction from a first side to a second side, and a main body portion extending along only a first portion of the length of the module and across the entire width of the module. The module includes a first projecting element adjacent the first end of the module and extending along a second portion of the length to the first end of the length, and extending across only a first portion of the width of the module, and a second projecting element adjacent the second end of the module and extending along a third portion of the length to the second end of the length, and extending across only a second portion of the width of the module.

20 Claims, 7 Drawing Sheets

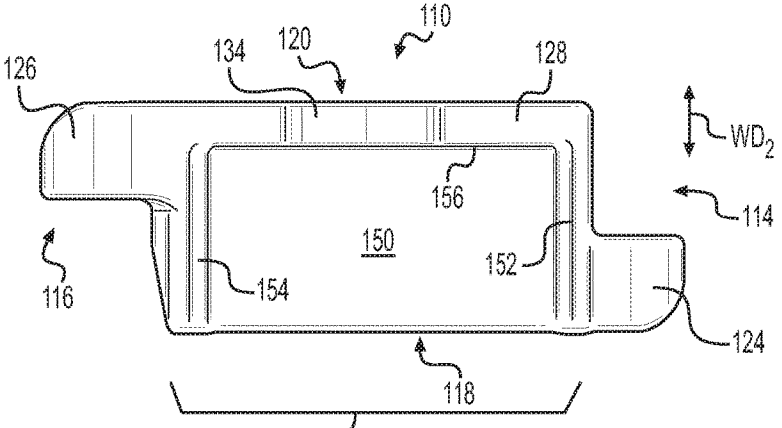
FIG. 14
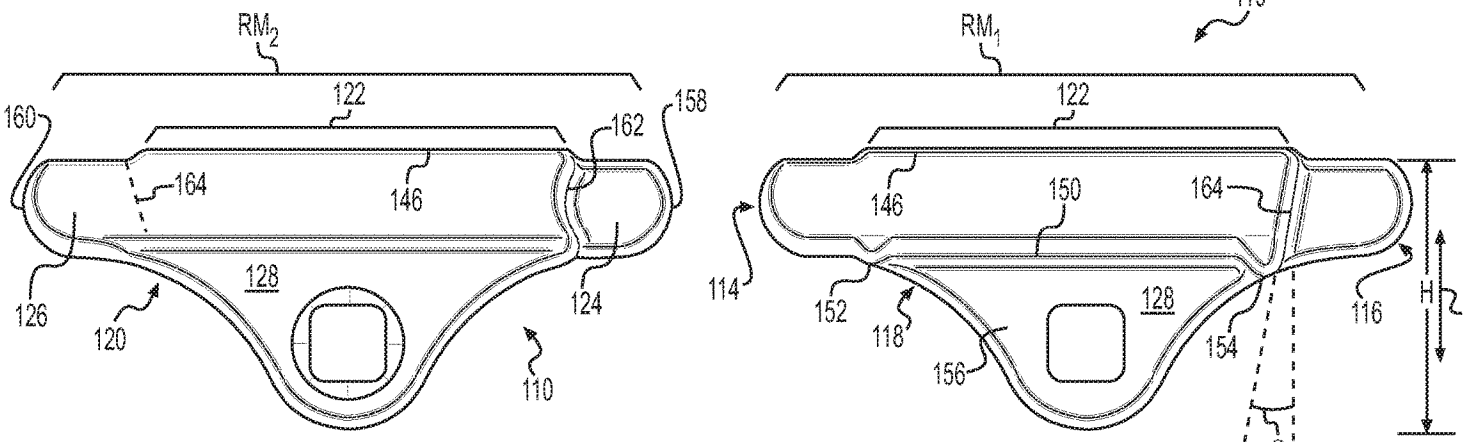
FIG. 15
FIG. 16

MODULAR SIDEBAR PROTECTING WEAR MEMBER AND SYSTEM

TECHNICAL FIELD

The present disclosure is directed to sidebar protection and, more particularly, is directed to a modular sidebar protecting wear member and system.

BACKGROUND

Many machines include implements that engage earth, rock, and other materials that may be abrasive and may cause implement damage and wear. Some such implements include buckets, scoops, shovels, dozer blades, scraper blades, etc., that include a horizontal edge that engages material and, in some cases, side edges that also engage the material. Buckets, scoops, and shovels generally are in the shape of a container for material and usually include a primary material engaging surface with a digging edge and two side edges. Some scraper blades also include side edges that, together with the blade itself may form a shallow container.

While it stands to reason that the horizontal or digging edge of a bucket or the ground engaging edge of a scraper blade, for example, will incur severe wear during operation where hard and abrasive materials are encountered, other implement edges, for example the side edges, also may be subjected to the same abrasive forces. The side edges of an implement may engage material with substantially the same forces exerted on a horizontally oriented digging edge of a bucket or blade. As a result, these edges also may incur severe wear. While side edges may sometimes be made more robust and somewhat reinforced by sidebars, these sidebars still may experience severe wear.

Implements that may be expected to encounter heavy abrasion and wear have typically been provided with replaceable wear members and shrouds usually made of more abrasion resistant material than the implements themselves. Such wear members and shrouds have been placed along edges of the implements to protect the edges and extend implement life. Various replaceable sidebar protectors have been devised to further protect implement side edges against abrasion and wear. Such sidebar protectors have generally been tailored to a particular implement, and even to a particular size of the same general type of implement. Some implements may have sides with straight edges, curved edges, or a combination of both straight portions and curved portions on the edges. Curved edges may be convex, concave, or a combination of both. As a result, a sidebar protector ordinarily may be more or less uniquely designed for a particular side edge contour. In addition, typical sidebar protectors attach to opposing sides of a sidebar, for example via a pair of depending attachment tabs that straddle the sidebar. As a result, a given sidebar protector may be limited to use on an implement with a given sidebar thickness.

There exists a need for a more universal sidebar protector and a more adaptable sidebar protection system. It would be both beneficial and desirable to provide a sidebar protector and protection system that could be readily adapted to the contour of a number of implements having differently contoured side edges. It also would be advantageous to provide a sidebar protector and protection system that could be readily adapted to implements of different sizes and with sidebars of different thicknesses.

One type of protection system for the side edges of a bucket is disclosed in U.S. Pat. No. 3,914,885 issued to Moreau on Oct. 28, 1975 ("the '885 patent"). The '885 patent discloses a system wherein a bucket has a leading edge of substantially circular and constant cross-section, with the leading edge disclosed as including both the edge of the base and the edges of the sides of the bucket. The protection system of the '885 patent includes a series of "rings" with an internal cross-section similar to that of the bucket leading edge. The individual rings may be slid onto an end of the leading edge and accumulated until the entire leading edge is protected by the series of rings. Worn rings may be replaced by removing the series of rings from an end of the leading edge until the worn rings are removed, replacing the worn rings with new rings, and then replacing rings until the entire leading edge is once again provided with rings.

While the system of the '885 patent may be useful for some applications, it may be problematic. The '885 patent discloses that the entire leading edge of the bucket must be of both a circular and a constant cross-section, and that the protective rings must likewise include an internal circular and constant cross-section. As a result, the system of the '885 patent is not universal and is not adaptable to either a large number of implements or implements with sidebars of varying contours. In addition the system of the '885 patent is not adaptable to implements with side edges of varying thicknesses.

SUMMARY

In one aspect, the present disclosure is directed to a sidebar protecting wear member. The sidebar protecting wear member may include a module having a length extending in a length direction from a first end to a second end, and a width extending in a width direction from a first side to a second side, the length being greater than the width. The module may include a main body portion extending along only a first portion of the length of the module and across the entire width of the module. The module also may include a first projecting element adjacent the first end of the module and extending along a second portion of the length to the first end of the length, and extending across only a first portion of the width of the module. The module also may include a second projecting element adjacent the second end of the module and extending along a third portion of the length to the second end of the length, and extending across only a second portion of the width of the module.

In another aspect, the present disclosure is directed to a modular sidebar protecting system. The modular sidebar protecting system may include a plurality of substantially identical modules having a length extending in a length direction from a first end to a second end, a width extending in a width direction from a first side to a second side, and a height extending in a height direction, the length being greater than the width. Each module may be configured to cover a material engaging edge of a sidebar of an implement with each module abutting an adjacent module. Each module may include a main body portion extending along only a first portion of the length of the module and across the entire width of the module. Each module also may include a first projecting element extending along a second portion of the length to the first end of the length, and extending across only a first portion of the width of the module. Each module also may include a second projecting element extending along a third portion of the length to the second end of the length, and extending across only a second portion of the width of the module.

In yet another aspect, the present disclosure is directed to an implement. The implement may include a material engaging surface, at least one side surface adjacent an end of the material engaging surface, and a modular sidebar protecting system. The implement also may include a sidebar on the at least one side surface and a plurality of substantially identical sidebar protecting modules individually engaging the sidebar, with each sidebar protecting module abutting an adjacent sidebar protecting module and with each sidebar protecting module including a length extending in a length direction from a first end to a second end, a width extending in a width direction from a first side to a second side, and a height extending in a height direction. Each sidebar protecting module may include a main body portion extending along only a first portion of the length of the module and across the entire width of the module. Each sidebar protecting module also may include a first projecting element extending along a second portion of the length to the first end of the length, and extending across only a first portion of the width of the module. Each sidebar protecting module also may include a second projecting element extending along a third portion of the length to the second end of the length, and extending across only a second portion of the width of the module.

BRIEF DESCRIPTION OF THE DRAWINGS

FIG. 14 is a bottom view of the modular sidebar protecting wear member illustrated in FIG. 13;

FIG. 15 is a side view of the modular sidebar protecting wear member illustrated in FIGS. 11-14;

FIG. 16 is an opposite side view of the modular sidebar protecting wear member illustrated in FIGS. 11-14;

DETAILED DESCRIPTION

Figure 1:
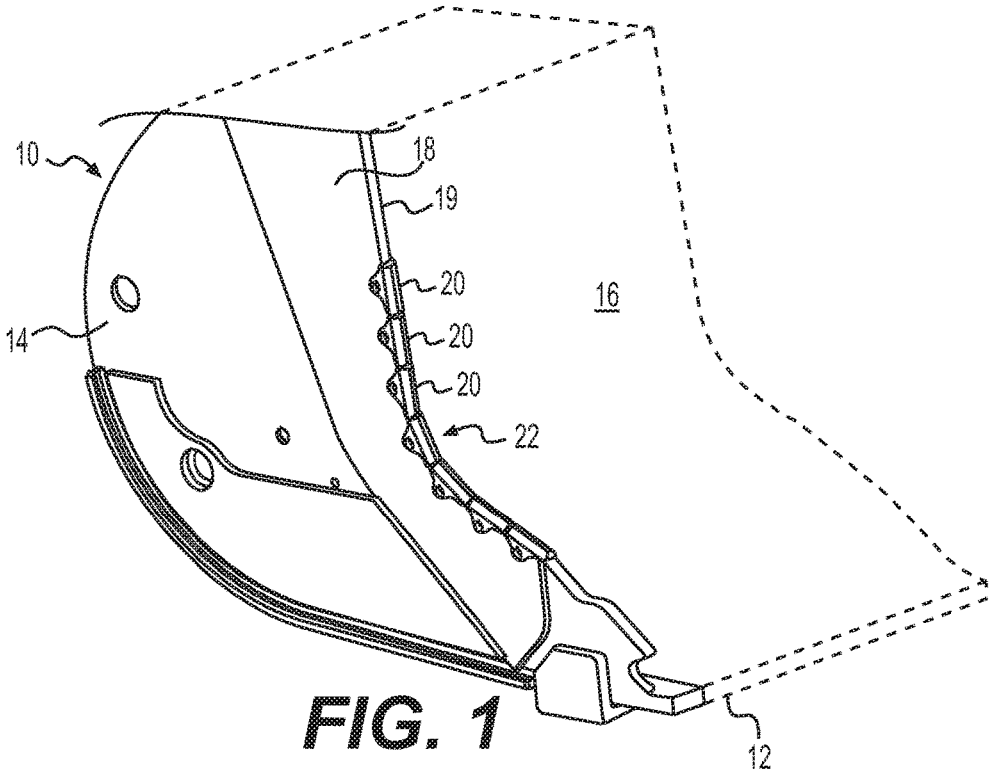
FIG. 1 illustrates an exemplary implement and a disclosed embodiment of a modular sidebar protecting wear member and system.

FIG. 1 illustrates, in perspective view, a portion of an exemplary implement 10, that may advantageously be provided with and benefit from disclosed embodiments of a modular sidebar protecting wear member and system. Implement 10 may be any type of bucket, scoop, shovel, or similar implement generally adapted for use with a machine for excavating or mining earth, rock, ore, or other materials. FIG. 1 illustrates a bucket-type implement 10 that includes a ground engaging edge 12, a side plate 14, and a primary material engaging surface 16, variously referred to in the art as a wrapper, bottom plate, etc. Implement 10 also may be a dozer blade, scraper blade, or other blade-type implement employed for moving earth and other materials and including side walls that effectively form, with the blade, a shallow container for material.

FIG. 1 also illustrates a sidebar 18 forming a part of side plate 14 of implement 10. Sidebar 18 typically may be a somewhat reinforced portion at the material engaging edge portion of an implement side plate intended to directly engage the material that may be handled by the implement and make the side plate more robust and resistant to deformation and abrasion. Sidebar 18, in FIG. 1, is illustrated as being provided with a disclosed embodiment of a modular sidebar protecting wear member 20 (or module 20) and a modular sidebar protecting system 22 attached to side edge 19 of sidebar 18.

Figure 2:
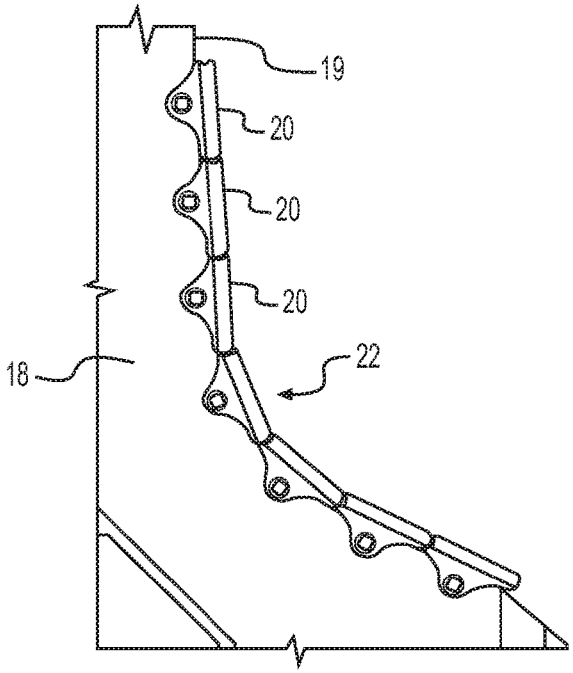
FIG. 2 is a somewhat enlarged side view of a portion of the implement and modular sidebar protecting wear member and system of FIG. 1.

Referring to FIG. 2, an enlargement of a portion of sidebar 18 with a disclosed embodiment of modules 20 and modular sidebar protecting system 22 is shown in side view to illustrate the abutting relationship of individual modules 20 to form modular sidebar protecting system 22 covering a portion of side edge 19 of sidebar 18. As can readily been seen in FIG. 2, a number of modules 20 may be mounted on sidebar 18 in abutting relationship. As disclosed in more detail hereafter, each module 20 may contact side edge 19 and be secured to one side of sidebar 18 via suitable attachment structure to form modular sidebar protecting system 22. Each module 20 may be short in length relative to a length of sidebar 18 and side edge 19 to be protected, and the number of modules 20 that may be employed with a given implement may vary considerably with the size and type of implement.

FIGS. 3-8 illustrate several different views, each to be described in turn, of a disclosed embodiment of a module 20 illustrated generally in FIGS. 1 and 2. In referring to the several views, terms such as "ends," "sides," "top," "above," "upwardly," "bottom," "below," "downwardly," etc., will be employed for a convenient frame of reference even though, during handling or in actual use on an implement, the orientation of modules 20 and modular sidebar protecting system 22 may vary considerably.

Figure 3:
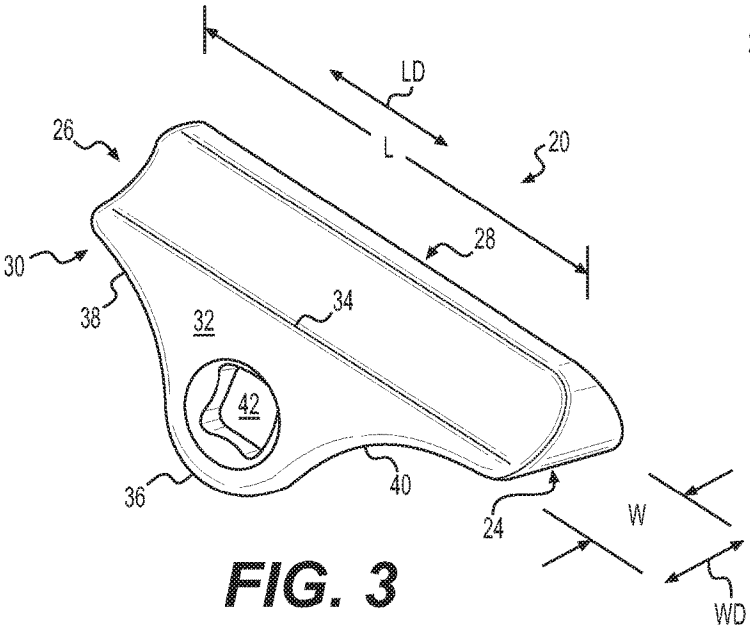
FIG. 3 is a perspective view of a disclosed embodiment of a modular sidebar protecting wear member.

Referring to FIG. 3, a first perspective view of module 20 is illustrated in which some features of module 20 may be seen. Module 20 may include a length L extending in a length direction LD from a first end 24 to a second end 26. Module 20 also may include a width W extending in a width direction WD from a first side 28 to a second side 30. Module 20 may be manufactured by casting or any of various other metal forming processes and may be made with various dimensions. For example, the length of a module 20 may be between three and nine inches (or roughly between 7.5 cm and 23 cm). A typical length may be approximately six inches (or roughly 15 cm) with a length to width ratio of approximately three to one.

One of first and second ends 24, 26, for example first end 24 in FIG. 3, may be shaped in some fashion. For example, first end 24 may include a curved surface that is convex. The other of first and second ends 24, 26, for example second end 26 in FIG. 3, likewise may be shaped. For example, second end 26 may include a curved surface that is concave. The radius of curvature of the curved surface that is convex may be substantially equal to the radius of curvature of the curved surface that is concave. The radius of curvature may be on the order of approximately 15 mm, for example, but other radii of curvature are contemplated.

An attachment tab 32 may extend from one side, for example side second 30 as illustrated in FIG. 3. Attachment tab 32 may originate along an edge 34 of module 20 and extend to a distal portion 36. Attachment tab 32 may be variously shaped. For example only, attachment tab 32 may include two concavely curved side surfaces 38 and 40 converging to the convexly curved distal portion 36. Attachment tab 32 may include an aperture 42 or other suitable expedient to enable attachment tab 32, and therefore module 20, to be attached to a sidebar 18 (see FIG. 2, for example). Attachment of module 20 via attachment tab 32 may be by way of a suitable bolt, pin, clip, or other fastening expedient. Other shapes for attachment tab 32 as well as other modes of fastening module 20 to a sidebar 18 are contemplated to be within the scope of this disclosure.

Figure 4:
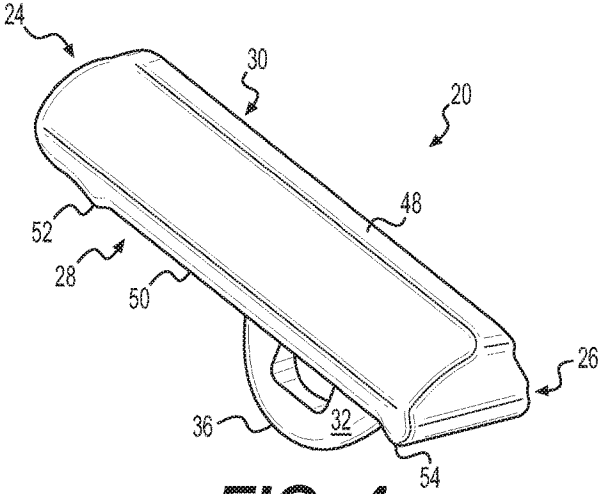
FIG. 4 is a different perspective view of the modular sidebar protecting wear member illustrated in FIG. 3.

FIG. 4 illustrates another perspective view of module 20. While FIG. 3 is viewed generally toward second side 30 and first end 24, by contrast FIG. 4 is viewed generally toward first side 28 and second end 26. Distal portion 36 of attachment tab 32 may be viewed in part extending from second side 30 which is not readily visible in FIG. 4. FIGS. 3 and 4 taken together illustrate the overall shape of an embodiment of module 20 from both first and second ends 24, 26 and both first and second sides 28, 30. Additional views of module 20 to be described will further aid the description of various features of module 20.

Figure 6:
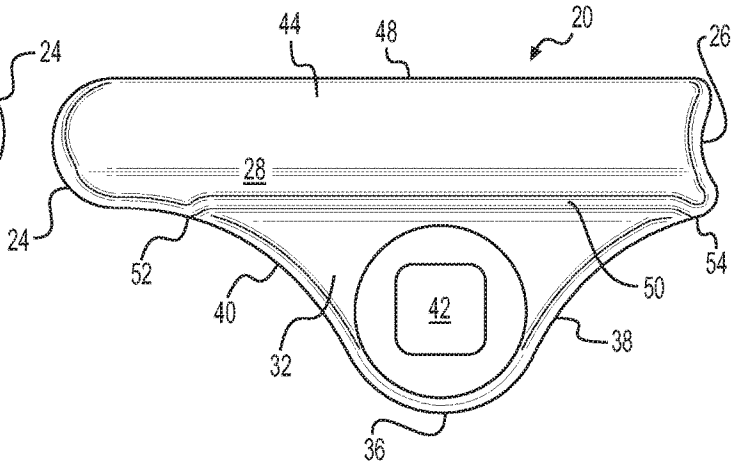
FIG. 6 is an opposite side view of the modular sidebar protecting wear member of FIG. 5.
Figure 5:
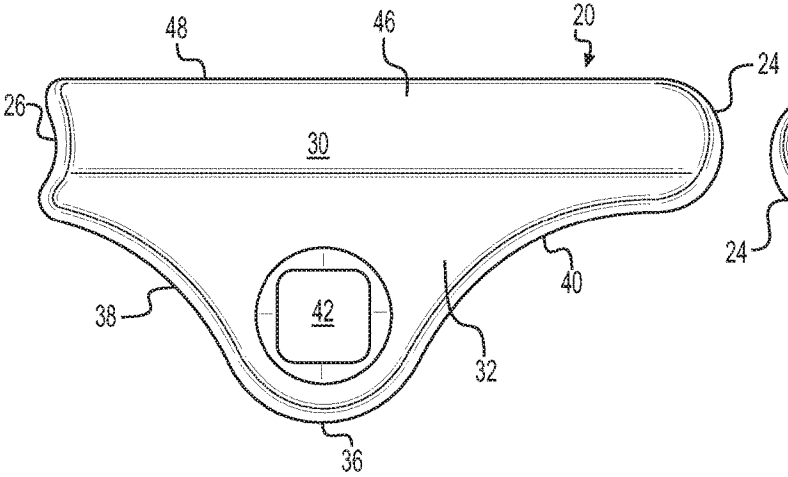
FIG. 5 is a side view of the modular sidebar protecting wear member of FIGS. 3 and 4.

FIGS. 5 and 6 illustrate opposite side views of the module 20 illustrated in perspective in FIGS. 3 and 4. In FIG. 5, module 20 may be viewed from second side 30. As disclosed in the description of FIGS. 3 and 4, first end 24 may be shaped, for example convexly curved as illustrated, and second end 26 also may be shaped, for example concavely curved. Attachment tab 32 also is illustrated in FIG. 5 on second side 30. FIG. 6 illustrates a view of module 20 from first side 28. Attachment tab 32 may be seen in FIG. 6, but the view is from an opposite side of attachment tab 32 from that seen in FIG. 5.

Figure 7:
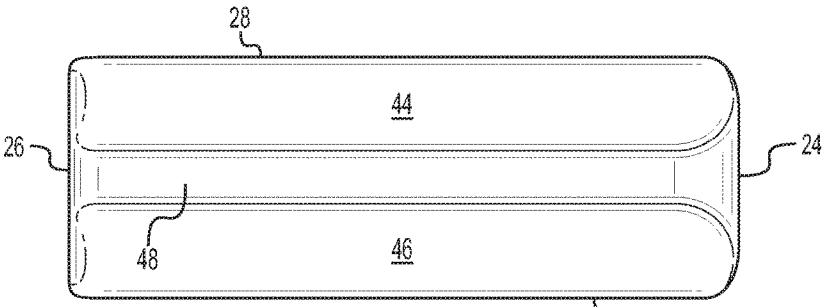
FIG. 7 is a top view of the modular sidebar protecting wear member of FIGS. 3-6.

FIG. 7 is a top view of the module 20 illustrated in FIGS. 3-6 with first end 24, second end 26, first side 28, and second side 30 designated following the orientation in FIGS. 3-6. FIG. 7 illustrates a first surface 44 and a second surface 46 (with first surface 44 visible in FIG. 6 and second surface 46 visible in FIG. 5). First and second surfaces 44, 46 may converge to a wear surface 48 (also indicated at the top of FIGS. 5 and 6). Wear surface 48 may be narrow in width direction WD relative to width W of module 20 and may extend in length direction LD approximately for the length L of module 20. The two surfaces 44, 46 may be planar, concavely curved, convexly curved, or somewhat irregular in topography.

Figure 8:
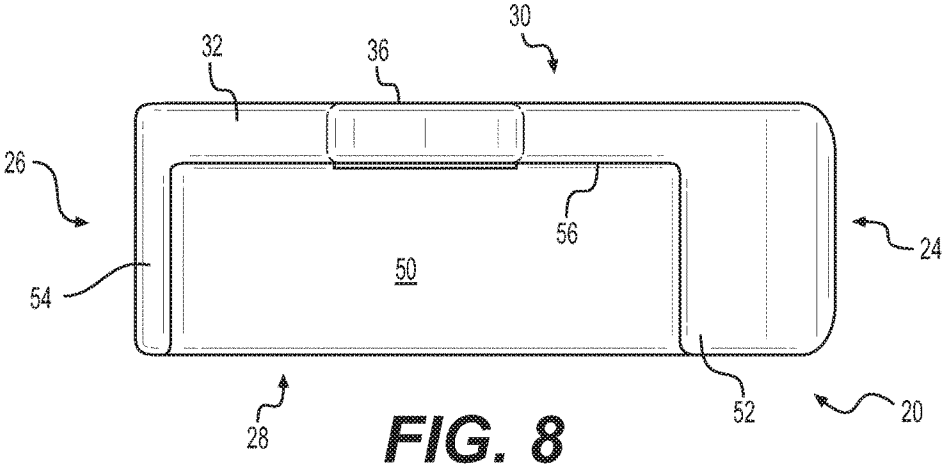
FIG. 8 is a bottom view of the modular sidebar protecting wear member of FIGS. 3-7.

FIG. 8 is a bottom view of the module 20 illustrated in FIGS. 3-7 with first end 24, second end 26, first side 28, and second side 30 designated following the orientation in FIGS. 3-7. Attachment tab 32 and its distal portion 36 also may be viewed from the bottom in FIG. 8. Module 20 may include a generally planar surface 50. Generally planar surface 50, in use of module 20 (see FIGS. 1 and 2, for example) is intended to be the surface of module 20 facing side edge 19 of sidebar 18. Generally planar surface 50 may include a plurality of sidebar engaging abutments protruding from generally planar surface 50. To that end, a first sidebar engaging abutment 52 may protrude from generally planar surface 50 at or adjacent first end 24, and a second sidebar engaging abutment 54 may protrude from generally planar surface 50 at or adjacent second end 26. First and second sidebar engaging abutments 52, 54 protruding from generally planar surface 50 are intended, in use, to make contact with side edge 19 of sidebar 18 (FIGS. 1 and 2, for example).

Still referring to FIG. 8, module 20 may, during use, be attached to a sidebar 18 (FIGS. 1 and 2) with attachment tab 32 extending along one side of sidebar 18, generally planar surface 50 facing side edge 19, and first and second sidebar engaging abutments 52, 54 making contact with side edge 19. As illustrated in FIG. 8, first and second sidebar engaging abutments 52, 54 may adjoin a surface 56 of attachment tab 32 and extend in the width direction WD of module 20 to first side 28 of module 20. It should be understood that attachment tab 32 may conveniently be formed at either first side 28 or at second side 30, with first and second sidebar engaging abutments 52, 54 extending to the opposite side.

Referring collectively now to FIGS. 4, 6, 7, and 8, first sidebar engaging abutment 52, second sidebar engagement 54, and generally planar surface 50 are indicated in FIG. 4, and wear surface 48 may extend substantially parallel to planar surface 50. Generally planar surface 50, first sidebar engaging abutment 52 and second sidebar engagement 54 also are indicated in FIG. 6, and it is readily apparent that wear surface 48 may extend substantially parallel to generally planar surface 50. Referring to both FIG. 7 and FIG. 8, converging first and second surfaces 44, 46 may be inclined at an acute angle relative to generally planar surface 50 as they converge toward each other and adjoin wear surface 48. First and second surfaces 44, 46 also may extend generally parallel to length direction LD. Attachment tab 32 may extend toward distal end 36 in a direction generally perpendicular to generally planar surface 50 and generally perpendicular to the length direction LD and the width direction WD of module 20.

Figure 9:
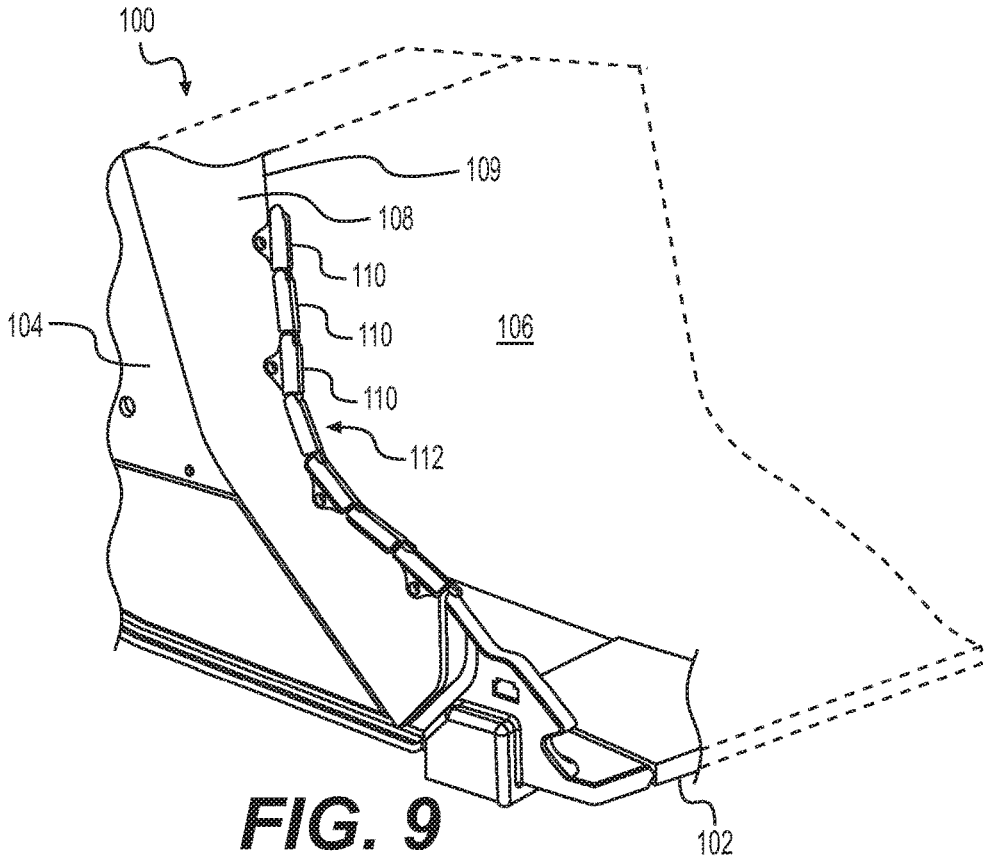
FIG. 9 illustrates an exemplary implement and another disclosed embodiment of a modular sidebar protecting wear member and system.
Figure 10:
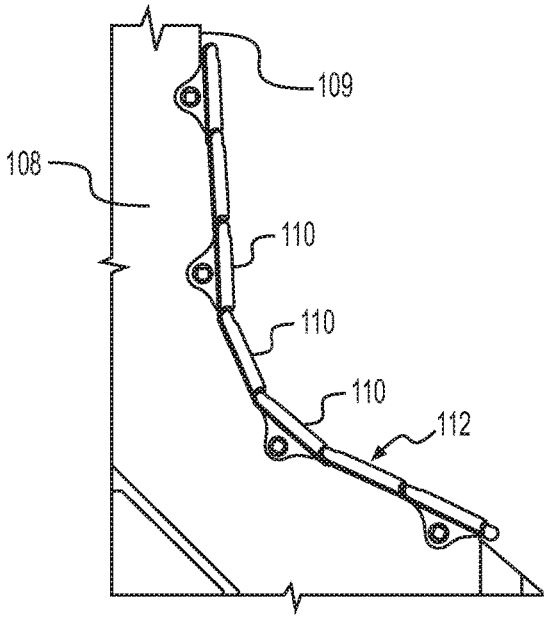
FIG. 10 is a somewhat enlarged side view of a portion of the implement and modular sidebar protecting wear member and system of FIG. 9.

FIGS. 9 and 10 are somewhat comparable to FIGS. 1 and 2, and illustrate another embodiment of a modular sidebar protecting wear member (or module) and system according to the disclosure. FIG. 9 illustrates a portion of an exemplary implement 100 that may be any type of bucket, scoop, or shovel generally adapted for use with a machine for excavating or mining earth, rock, ore, or other materials. The bucket-type implement 100 may include a ground engaging edge 102, a side plate 104, and a primary material engaging surface 106. Implement 100 also may be a dozer blade, scraper blade, or other blade-type implement employed for moving earth and other materials and including side walls that effectively form, with the blade, a shallow container for material.

FIG. 9 also illustrates a sidebar 108 forming a part of side plate 104 of implement 100. Sidebar 108, in FIG. 1, is illustrated as being provided with a disclosed embodiment of a modular sidebar protecting wear member or module 110 and a modular sidebar protecting system 112 attached to side edge 109 of sidebar 108. Referring to FIG. 10, an enlarged view of sidebar 108 with a disclosed embodiment of modules 110 and modular sidebar protecting system 112 is shown in side view to illustrate the cooperating relationship of individual modules 110 to form modular sidebar protecting system 112 covering a portion of side edge 109 of sidebar 108.

FIGS. 11-16 illustrate several different views, each to be described in turn, of the disclosed embodiment of module 110 illustrated generally in FIGS. 9 and 10. In referring to the several views illustrated in FIGS. 11-16, terms such as "ends," "sides," "top," "above," "upwardly," "bottom," "below," "downwardly," etc., will be employed for a convenient frame of reference even though, in actual handling and use on an implement, the orientation of modules 110 and modular sidebar protecting system 112 may vary considerably.

Figure 11:
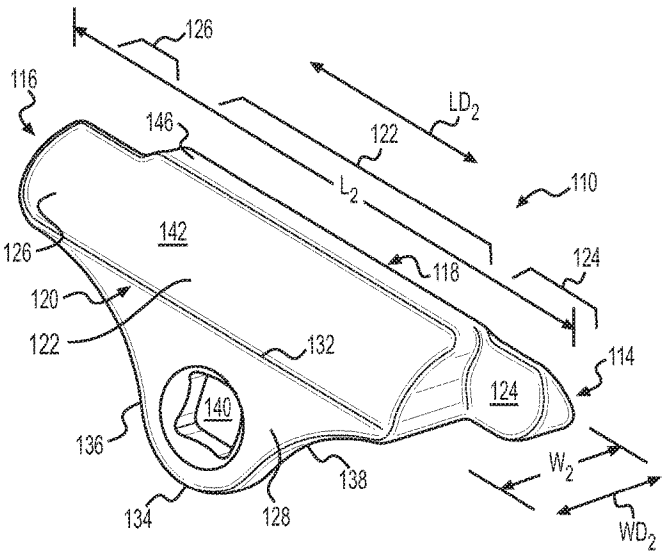
FIG. 11 is a perspective view of the disclosed embodiment of a modular sidebar protecting wear member illustrated in FIGS. 9 and 10.

Referring to FIG. 11, a first perspective view of module 110 is illustrated in which some features of module 110 may be seen. Module 110 may include a length $L_2$ extending in a length direction $LD_2$ from a first end 114 to a second end 116. Module 110 also may include a width $W_2$ extending in a width direction $WD_2$ from a first side 118 to a second side 120. Module 110 may include a main body portion 122 extending along only a first portion of the length $L_2$ of module 110 and across the entire width $W_2$ of the module 110. Module 110 also may include a first projecting element 124 extending along a second portion of the length $L_2$ to the first end 114 of length $L_2$, and extending across only a first portion of the width $W_2$ of module 110. Module 110 also may include a second projecting element 126 extending along a third portion of the length $L_2$ to the second end 116 of length $L_2$, and extending across only a second portion of the width $W_2$ of module 110.

An exemplary length for a module 110 may be between three and nine inches (or roughly between 7.5 cm and 23 cm). A typical length may be approximately six inches (or roughly 15 cm) with a length to width ratio of approximately three to one. The portion of length $L_2$ over which main body portion 122 extends may be, for example, approximately two-thirds of the entire length $L_2$ with each of first and second projecting elements 124 and 126 extending approximately one-sixth of the entire length, for example. A typical portion of length $L_2$ for main body portion 122 may be four inches (roughly 10 cm), for example, with each projecting element 124, 126 typically extending from main body portion 122 for a portion of length $L_2$ of one inch (roughly 2.5 cm), for example.

An attachment tab 128 may extend from one side, for example second side 120 as illustrated in FIG. 11. Attachment tab 128 may originate along an edge 132 of module 110 and extend to a distal portion 134. Attachment tab 128 may be variously shaped. For example, attachment tab 128 may include two concavely curved side surfaces 136 and 138 converging to the convexly curved distal portion 134. Attachment tab 128 may include an aperture 140 or other suitable expedient to enable attachment tab 128, and therefore module 110, to be attached to a sidebar 108 (FIG. 10, for example). Attachment of module 110 via attachment tab 128 may be by way of a suitable bolt, pin, clip, or any other fastening expedient. Other shapes for attachment tab 128 as well as other modes of fastening module 110 to a sidebar 108 are contemplated to be within the scope of this disclosure.

Figure 12:
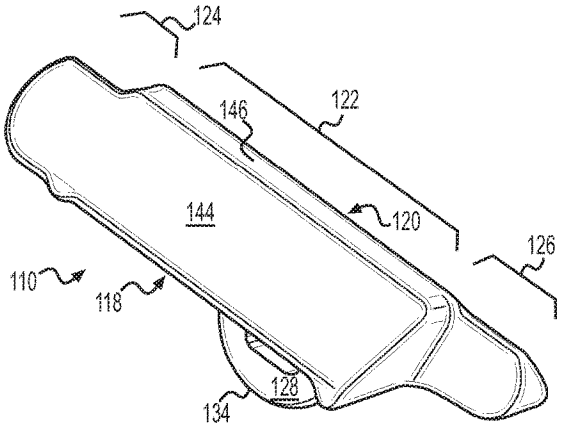
FIG. 12 is a different perspective view of the modular sidebar protecting wear member illustrated in FIG. 11.

FIG. 12 illustrates another perspective view of module 110. While FIG. 11 is viewed generally toward second side 120 and first end 114, by contrast FIG. 12 is viewed generally toward first side 118 and second end 116. Distal portion 134 of attachment tab 128 may be viewed in part extending from second side 120 which is not readily visible in FIG. 12. FIGS. 11 and 12 taken together illustrate the overall shape of this embodiment of module 110 from both first and second ends 114, 116 and both first and second sides 118, 120. FIG. 12 also illustrates main body portion 122, first projecting element 124, and second projecting element 126.

Figure 13:
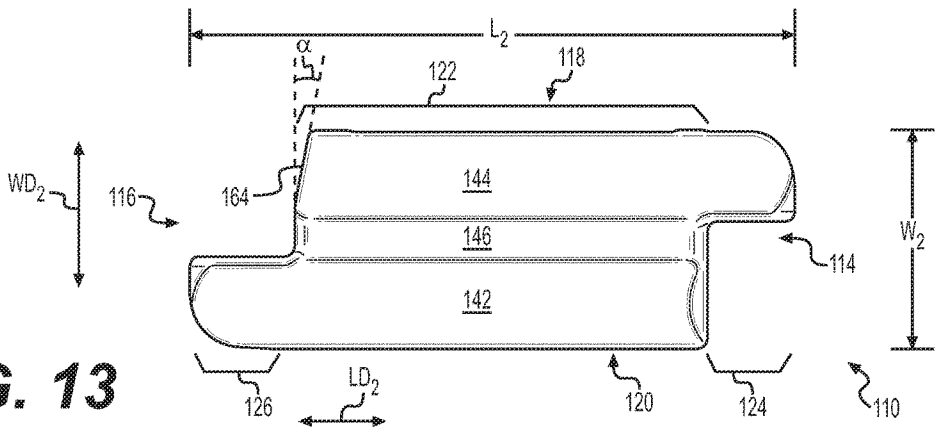
FIG. 13 is a top view of the modular sidebar protecting wear member illustrated in FIGS. 11 and 12.

FIG. 13 is a top view of module 110 facilitating description of certain features of module 110. As described in connection with FIGS. 11 and 12, module 110 includes a main body portion 122 extending in length direction $LD_2$ along only a first portion of length $L_2$. Module 110 also includes first projecting element 124 extending in length direction $LD_2$ along a second portion of length $L_2$ and second projecting element 126 extending in length direction $LD_2$ along a third portion of length $L_2$. It is clear from the view in FIG. 13 that, while main body portion 122 extend across the entire width $W_2$ of module 110, first projecting element 124 extends across only a first portion of width $W_2$, and second projecting element 126 extends across only a second portion of width $W_2$.

Still referring to FIG. 13, a first surface 142 and a second surface 144 (with first surface 142 visible in FIG. 11 and second surface 144 visible in FIG. 12) may converge to a wear surface 146 (also indicated at the top of FIGS. 11 and 12). Wear surface 146 may be narrow in width direction $WD_2$ relative to width $W_2$ of module 110 and may extend in length direction $LD_2$ approximately for the first portion of length $L_2$ along which main body portion 122 extends. The two surfaces 142, 144 may be planar, concavely curved, convexly curved, or somewhat irregular in topography.

FIG. 14 is a bottom view of module 110 with first end 114, second end 116, first side 118, and second side 120 designated following the orientation in FIGS. 11-13. Attachment tab 128 and its distal portion 134 also may be viewed from the bottom in FIG. 14. Module 110 may include a generally planar surface 150. Generally planar surface 150, in use of module 110 (see FIGS. 9 and 10, for example) is intended to be the surface of module 110 facing side edge 109 of sidebar 108. Generally planar surface 150 may include a plurality of sidebar engaging abutments protruding from generally planar surface 150. To that end, a first sidebar engaging abutment 152 may protrude from generally planar surface 150 adjacent first projecting element 124, and a second sidebar engaging abutment 154 may protrude from generally planar surface 150 adjacent second projecting element 126. First and second sidebar engaging abutments 152, 154 protruding from generally planar surface 150 are intended, in use, to make contact with side edge 109 of sidebar 108 (FIGS. 9 and 10, for example).

Wear surface 146 may extend substantially parallel to generally planar surface 150. Referring to both FIG. 13 and FIG. 14, converging first and second surfaces 142 and 144 may be inclined at an acute angle relative to generally planar surface 150 as they converge toward each other and adjoin wear surface 146. First and second surfaces 142 and 144 also may extend generally parallel to length direction $LD_2$. Attachment tab 128 may extend toward distal end 134 in a direction generally perpendicular to planar surface 150 and generally perpendicular to length direction $LD_2$ and width direction $WD_2$.

Still referring to FIG. 14, module 110 may, during use, be attached to a sidebar 108 (FIGS. 9 and 10) with attachment tab 128 extending along one side of sidebar 108, with generally planar surface 150 facing side edge 109, and with first and second sidebar engaging abutments 152, 154 making contact with side edge 109. As illustrated in FIG. 14, first and second sidebar engaging abutments 152, 154 may adjoin a surface 156 of attachment tab 128 and extend in the width direction $WD_2$ of module 110 to first side 118 of module 110. It should be understood that attachment tab 128 may conveniently be formed at either first side 118 or at second side 120, with first and second sidebar engaging abutments 152, 154 extending to the opposite side. As previously described, first sidebar engaging abutment 152 may be located at one end of main body portion 122 adjacent projecting element 124, and second sidebar engaging abutment 154 may be located at an opposite end of main body portion 122 adjacent projecting element 126.

FIGS. 15 and 16 illustrate opposite side views of the module 110 illustrated in perspective in FIGS. 11 and 12. In FIG. 15, module 110 may be viewed from second side 120, while in FIG. 16, module 110 may be viewed from first side 118. Attachment tab 128 also is illustrated in FIG. 15 on second side 120, and the surface 156 on the opposite side of attachment tab 128 is visible in FIG. 16. Both of first projecting member 124 and second projecting member 126 may include end surfaces that advantageously may be shaped, and main body portion 122 includes end faces that likewise advantageously may be shaped.

Still referring to FIGS. 15 and 16, end surface 158 of first projecting member 124 may be convexly curved, and end surface 160 of second projecting member 126 likewise may be convexly curved. A first end face portion 162 of main body portion 122 may be shaped, for example concavely curved (FIG. 15). A second end face portion 164 of main body portion 122 may include a planar shape (FIG. 16). Referring again to FIG. 13, for example, the planar shape of second end face portion 164 may be oriented at a slight acute angle a relative to width direction $WD_2$. As a result, second end face portion 164 may slant slightly toward first side 118 such that main body portion 122 may decrease slightly in length along first side 118. Referring back to FIG. 16, for example, it may be seen that module 110 includes a height H extending in height direction HD. Second end face portion 164 also may be oriented at a slight acute angle β relative to height direction HD of module 110. As a result, second end face portion 164 also may slant slightly away from second end 116 from wear surface 146 toward generally planar surface 150.

The radius of curvature of convexly curved end surfaces 158 and 160 may have radii of curvatures that are substantially equal. Also, the radius of curvature of concavely curved first end face portion 162 of main body portion 122 may have a radius of curvature that is substantially equal to the radius of curvature of end surface 158 and end surface 160. The radius of curvature of each of end surfaces 158 and 160 and first end face 162 may be on the order of approximately 15 mm, for example, but other radii of curvature are contemplated. The angle a relative to width direction $WD_2$ may be slight but may vary. For example, angle a may be on the order of one to ten degrees. The angle β relative to height direction HD also may be slight but may vary. For example, angle β may be on the order of one to ten degrees.

Figure 17:
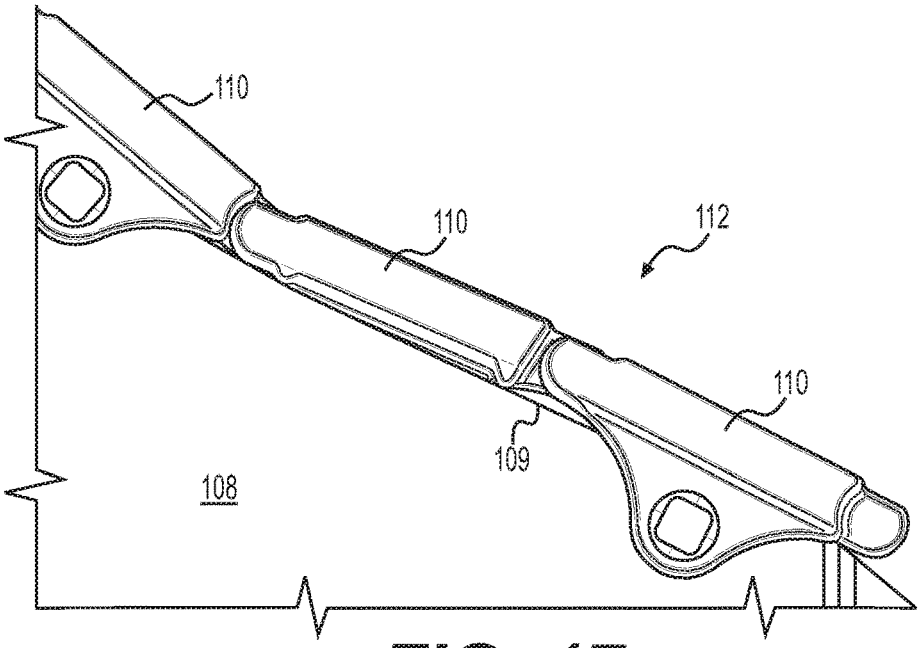
FIG. 17 is an enlarged view of the modular sidebar protecting wear members and system illustrated in FIGS. 9 and 10.
Figure 18:
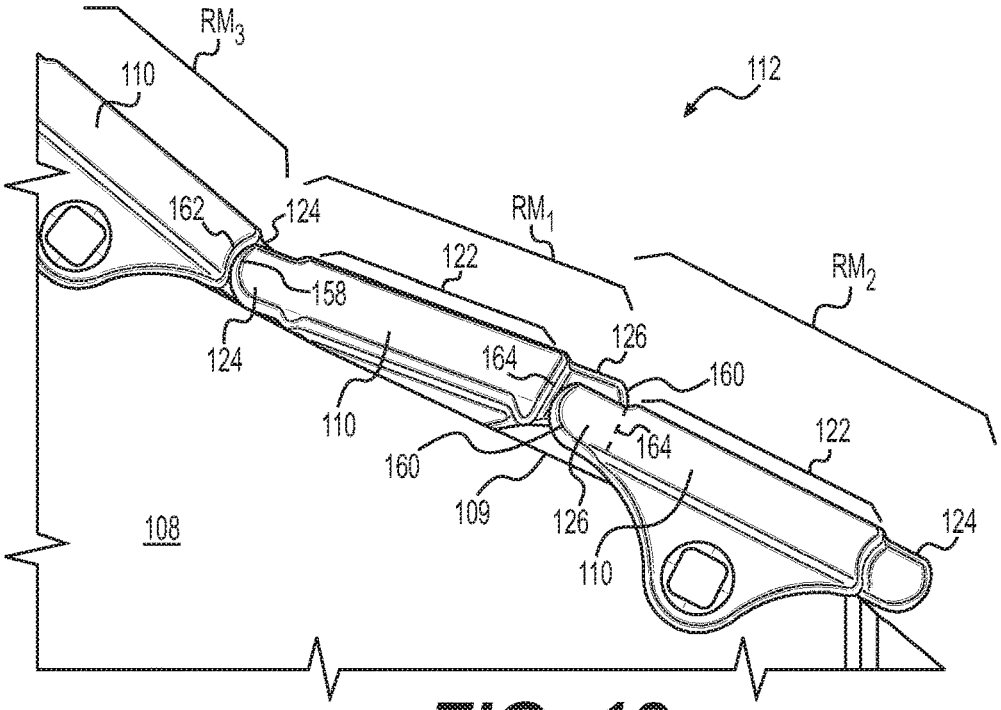
FIG. 18 is another enlarged view of the modular sidebar protecting wear members and system illustrated in FIG. 17.

FIGS. 17 and 18 are enlarged views of a portion of modular sidebar protecting system 112 illustrated in FIG. 10 showing only three of the several modules 110 along a portion of sidebar 108. FIG. 17 illustrates adjacent modules 110 mounted to sidebar 108 and protecting side edge 109. FIG. 18 illustrates a scenario where a module 110 mounted between two adjacent modules 110 is in the process of being removed or in the process of being replaced. FIGS. 17 and 18 illustrate certain features of modules 110 and how individual modules 110 cooperate with one another in the disclosed modular sidebar protecting system 112.

FIGS. 17 and 18 (as well as FIGS. 9 and 10) illustrate that, in this disclosed embodiment, alternate ones of modules 110 in modular sidebar protecting system 112 may be attached to an opposite side of sidebar 108. Also, a first projecting element 124 of one module 110 may overlap a first projecting element 124 of an adjacent module 110, and a second projecting element 126 of one module 110 may overlap a second projecting element 126 of an adjacent module 110, and this may remain true for each module 110 except for end modules 110 that will overlap on only one end 114 or 116.

Considering FIGS. 17 and 18 along with the larger side views of modules 110 in FIGS. 15 and 16, it should be reiterated that each module 110 is substantially identical to adjacent modules 110. As a description aid, one module 110 in FIG. 18 is labeled representative module RM1, corresponding to the view in FIG. 16, and an adjacent module 110 is labeled representative module RM2, corresponding to the view in FIG. 15. It readily may be seen that a typical relationship of RM1 and RM2 in use may be that second projecting elements 126 of adjacent modules RM1 and RM2 overlap each other along a length of side edge 109, with convexly curved end surfaces 160 of second projecting elements 126 abutting or closely adjacent planar second end face portions 164 of main body portions 122. Also, in use, first projecting elements 124 of adjacent modules RM1 and RM3 (with RM3 attached on the opposite side of sidebar 108 from RM1) may overlap each other along a length of side edge 109 with convexly curved end surfaces 158 of first projecting elements 124 abutting concavely curved first end face portions 162 of main body portions 122.

Where it becomes necessary to remove and replace a module 110, the fact that second end face portion 164 of main body portion 122 may be planar in shape will facilitate removal of a module 110 that is between two other modules 110 without the necessity to remove each module 110 up to the one that requires replacement. Further, because second end face portion 164, in addition to being planar in shape, may be oriented at a slight acute angel a relative to width direction $WD_2$, and also may be oriented at a slight acute angel β relative to height direction HD, may even further facilitate removal of an intermediate module 110.

FIGS. 17 and 18, as well as FIGS. 9 and 10 clearly illustrate that each adjacent module 110 may, via attachment tab 128, be suitably fastened to an opposite side of sidebar 108. In addition, FIGS. 17 and 18 illustrate that modules 110, when attached to a sidebar 108 to form a sidebar protecting system 112, may be characterized as being in a "zig-zag" pattern or arrangement. A first projecting element 124 of one module 110 overlaps a first projecting element 124 of an adjacent module 110, and a second projecting element 126 of one module 110 overlaps a second projecting element 126 of an adjacent module 110.

INDUSTRIAL APPLICABILITY

The disclosed modular sidebar protecting wear member and system may be applicable to protect sidebars of various types and sizes of implements regardless of the contour of an edge of the sidebar. The disclosed modular system offers distinct advantages over typical shrouds and protective wear members that may currently be employed as sidebar protection. Because the system is modular, only a single modular element is required to be manufactured, with multiple copies of the same single modular element forming a system that may act as protection for a wide variety of implement types and sizes.

Whereas existing sidebar protectors may not be readily adaptable to implements for which they were not specifically designed, the disclosed unique modular system may be adapted to implements having sidebars of various shapes and sizes. Because the disclosed modules are relatively small in size relative to implements for which they are intended, the number of modules needed for a given implement may readily be abutted or adjacently mounted end to end to form the length of sidebar protection needed.

Implements, such as buckets and scraper blades, may include sidebars of varying lengths (for example, measured in feet) and with varying contoured sidebar edges (for example, curved concave and/or convex, straight, or a combination of curved and straight). Each size of implement and contour of sidebar edge ordinarily would require a specifically designed sidebar protector to offer adequate protection. The disclosed modules (for example, measured in inches and typically approximately six inches in length) may offer the necessary protection for an implement regardless of size and contour of the sidebar edge.

Each module may include a sidebar engaging abutment protruding from a bottom planar surface adjacent each end of the module. This feature may yield two lines of contact with an edge of a sidebar. Because each module is relative short in length relative to the overall length of a sidebar edge, this may enable a module to fit closely to a sidebar edge regardless whether the edge contour curves concavely or convexly or is straight.

Currently employed sidebar protectors use a fastening system that requires what is referred to in the art as different "strap gaps" depending on how thick a sidebar is. In other words, for a relatively robust bucket or other implement with a sidebar thickness of approximately 2 inches (or roughly 5 cm), the gap between attachment tabs extending along each side of the sidebar would need to accommodate that thickness, while for a less robust bucket or other implement with a sidebar thickness of less than 1 inch (roughly less than 2.5 cm), for example, a differently formed sidebar protector would be needed. Another advantageous feature of the disclosed embodiments is that each module of the system attaches to a sidebar at only one side of the sidebar. This one-sided protection system eliminates the so-called "strap gap" problem with currently employed sidebar protectors. With disclosed embodiments, the same modules and system may be employed regardless of sidebar thickness. That is to say, a module approximately six inches (roughly 15 cm) in length and approximately 2 inches (roughly 5 cm) in width could be attached to an implement sidebar whether the sidebar is approximately 2 inches wide or less.

Because the disclosed system is made up of substantially identical modular wear elements, or modules, the casting or other metal forming process employed to manufacture the sidebar protecting system is relatively straightforward and applicable to various implements with differing sidebars since only a single module needs to be formed. Whether a sidebar shape is concavely curved, convexly curved, straight, or a combination thereof, the disclosed modules forming the disclosed modular system will be able to accommodate the shape and provide the needed sidebar protection.

The unique system also may enable an entity with a number of machines with implements operating in abrasive conditions to forego the need to have spare sidebar protectors of various types on hand. It only may be necessary to keep a supply of the disclosed modules on hand and, when replacement of a sidebar protector becomes necessary, the substantially identical modules may be abutted end to end to the extent necessary to satisfactorily protect the sidebar.

Each module may have shaped end surfaces, and when assembled as a sidebar protecting system on an implement a convexly curved end surface of one module may conformably fit against a concavely curved end surface of an adjacent module. In this way, adjacent modules may support each other in resisting side forces that may occur during implement use. It is contemplated that conformable shapes other than convex and concave curves may be employed on modules of a given system. End surfaces of modules may not necessarily be curved, but a module may include one end surface projecting slightly to a point or truncated surface with the other end surface being slightly indented.

The disclosed embodiment illustrated in FIGS. 9-18 may be characterized as forming a "zig-zag" pattern with a projecting element of one module overlapping a projecting element of an adjacent module. An advantage of this embodiment is that the "zig-zag" pattern and the attachment of alternate modules to an opposite side of a sidebar, in use, enhances mutual support by modules of adjacent modules and helps in resisting pull off and twisting loads that may be placed on the modules during implement use.

Modules accordingly to disclosed embodiments may be manufactured by any of generally accepted metal forming techniques such as, for example, casting, molding, and forging. In addition, it is contemplated that modules according to disclosed embodiments may be manufactured by additive manufacturing/fabrication processes that include techniques such as, for example, 3D printing. Modules under the disclosure may be manufactured from any know metal or metal alloy competent to serve as a suitable wear and abrasion resistant material.

Use of the term "generally" within this specification, (e.g., generally perpendicular, generally equal, generally planar, etc.) is intended to take into account those situations wherein the components and relationships referenced may deviate from an absolute by normal and accepted industry manufacturing tolerances. Similarly, use of the term "substantially" within this specification, (e.g., substantially equal, substantially identical, substantially parallel, etc.) is intended to take into account those situations wherein the components and relationships referenced may deviate from an absolute by normal and accepted industry manufacturing tolerances.

It will be apparent to those skilled in the art that various modifications and variations can be made in the disclosed modular sidebar protecting wear member and system without departing from the scope of the disclosure. Other embodiments of the disclosed modular sidebar protecting wear member and system will be apparent to those skilled in the art from consideration of the specification. It is intended that the specification and examples be considered as exemplary only, with a true scope of the disclosure being indicated by the following claims and their equivalents.

What is claimed is:

1. A sidebar protecting wear member, comprising:

a module having a length extending in a length direction from a first end to a second end, and a width extending in a width direction from a first side to a second side, the length being greater than the width;

the module including a main body portion extending along only a first portion of the length of the module and across the entire width of the module;

a first projecting element adjacent the first end of the module and extending along a second portion of the length to the first end of the length, and extending across only a first portion of the width of the module; and a second projecting element adjacent the second end of the module and extending along a third portion of the length to the second end of the length, and extending across only a second portion of the width of the module.

2. The sidebar protecting wear member of claim 1, wherein the first projecting element is adjacent the first side of the module, and the second projecting element is adjacent the second side of the module.

3. The sidebar protecting wear member of claim 1, wherein the main body portion includes a generally planar surface and a plurality of sidebar engaging abutments protruding from the generally planar surface.

4. The sidebar protecting wear member of claim 3, wherein the plurality of sidebar engaging abutments include a first abutment protruding from the generally planar surface adjacent the first projecting element, and a second abutment protruding from the generally planar surface adjacent the second projecting element.

5. The sidebar protecting wear member of claim 3, further including an attachment tab on the module at only one of the first and second sides of the module and extending in a direction generally perpendicular to the generally planar surface.

6. The sidebar protecting wear member of claim 3, wherein the module includes two surfaces inclined at an acute angle relative to the generally planar surface and converging toward each other to a wear surface extending generally parallel to the generally planar surface.

7. The sidebar protecting wear member of claim 1, wherein both the first projecting element and the second projecting element include an end surface that is convexly curved.

8. The sidebar protecting wear member of claim 7, wherein the main body portion includes a first end face portion that includes a concavely curved surface, and a second end face portion that includes a planar surface.

9. The sidebar protecting wear member of claim 8, wherein the planar surface of the second end face portion is oriented at an acute angle relative to the width direction.

10. A modular sidebar protecting system, comprising:

a plurality of substantially identical modules having a length extending in a length direction from a first end to a second end, a width extending in a width direction from a first side to a second side, and a height extending in a height direction, the length being greater than the width, wherein each module is configured to cover a material engaging edge of a sidebar of an implement with each module abutting an adjacent module, each module including:

a main body portion extending along only a first portion of the length of the module and across the entire width of the module;

a first projecting element extending along a second portion of the length to the first end of the length, and extending across only a first portion of the width of the module; and a second projecting element extending along a third portion of the length to the second end of the length, and extending across only a second portion of the width of the module.

11. The modular sidebar protecting system of claim 10, wherein each module includes an attachment tab at only one of the first and second sides of the module configured to attach the module to a sidebar.

12. The modular sidebar protecting system of claim 11, wherein one of the first and second projecting elements of each module abutting an adjacent module overlaps one of the first and second projecting elements of the adjacent module along the length direction.

13. The modular sidebar protecting system of claim 12, wherein the main body portion of each module includes a first end face portion that includes a concavely curved surface, and a second end face portion that includes a planar surface, and wherein both the first projecting element and the second projecting element include an end surface that is convexly curved.

14. The modular sidebar protecting system of claim 13, wherein the convexly curved end surface of one of the first and second projecting elements abuts the concavely curved surface of the first end face portion of an adjacent module, and the convexly curved end surface of the other of the first and second projecting elements is adjacent the planar surface of the second end face portion of another adjacent module.

15. The modular sidebar protecting system of claim 14, including a generally planar surface on the module configured to face a material engaging edge of a sidebar, and two surfaces inclined at an acute angle relative to the generally planar surface and converging toward each other to a wear surface.

16. The modular sidebar protecting system of claim 10, including a generally planar surface on each module configured to face a material engaging edge of a sidebar, and two surfaces inclined at an acute angle relative to the generally planar surface and converging toward each other to a wear surface, and sidebar engaging abutments protruding from the generally planar surface adjacent both the first projecting element and the second projecting element of each module.

17. An implement including a material engaging surface, at least one side surface adjacent an end of the material engaging surface, and a modular sidebar protecting system, comprising:

a sidebar on the at least one side surface;

a plurality of substantially identical sidebar protecting modules individually engaging the sidebar, with each sidebar protecting module abutting an adjacent sidebar protecting module and with each sidebar protecting module including a length extending in a length direction from a first end to a second end, a width extending in a width direction from a first side to a second side, and a height extending in a height direction, each sidebar protecting module including:

a main body portion extending along only a first portion of the length of the module and across the entire width of the module;

a first projecting element extending along a second portion of the length to the first end of the length, and extending across only a first portion of the width of the module; and a second projecting element extending along a third portion of the length to the second end of the length, and extending across only a second portion of the width of the module.

18. The implement of claim 17, wherein the main body portion of each module includes a first end face portion with a concavely curved surface, and a second end face portion that includes a planar surface inclined at an acute angle relative to both the width direction and the height direction, and wherein both the first projecting element and the second projecting element include an end surface that is convexly curved, and wherein the convexly curved end surface of one of the first and second projecting elements abuts the concavely curved surface of the first end face portion of the main body portion of an adjacent module, and the convexly curved end surface of the other of the first and second projecting elements is adjacent the planar surface of the second end face portion of the main body portion of another adjacent module.

19. The implement of claim 18, further including an attachment tab extending from only one of the first and second sides of each module, and wherein the attachment tab of one module is attached to one side of the sidebar, and the attachment tab of an adjacent module is attached to an opposite side of the sidebar.

20. The implement of claim 18, wherein each module includes a generally planar surface on the module configured to face a material engaging edge of a sidebar, and two surfaces inclined at an acute angle relative to the generally planar surface, extending generally parallel to a length direction of the generally planar surface, and converging toward each other to a wear surface extending generally parallel to the generally planar surface.

* * * * *